US007415840B2

(12) United States Patent
Eaton et al.

(10) Patent No.: US 7,415,840 B2
(45) Date of Patent: Aug. 26, 2008

(54) OPTIMIZED LNG SYSTEM WITH LIQUID EXPANDER

(75) Inventors: Anthony P. Eaton, Sugar Land, TX (US); Wesley R. Qualls, Katy, TX (US)

(73) Assignee: ConocoPhillips Company

( * ) Notice: Subject to any disclaimer, the term of this patent is extended or adjusted under 35 U.S.C. 154(b) by 365 days.

(21) Appl. No.: 11/283,475

(22) Filed: Nov. 18, 2005

(65) Prior Publication Data

US 2007/0113584 A1 May 24, 2007

(51) Int. Cl.
*F25J 1/00* (2006.01)

(52) U.S. Cl. ..... 62/611; 62/612

(58) Field of Classification Search ..... 62/611, 62/612

See application file for complete search history.

(56) References Cited

U.S. PATENT DOCUMENTS 3,616,652 A 11/1971 Engel
4,566,885 A * 1/1986 Haak ..... 62/613
5,613,373 A * 3/1997 Grenier ..... 62/612
5,689,141 A * 11/1997 Kikkawa et al. ..... 290/52
5,755,114 A 5/1998 Foglietta
5,916,260 A * 6/1999 Dubar ..... 62/613
6,250,244 B1 6/2001 Dubar et al.
6,289,692 B1 9/2001 Houser et al.
6,449,984 B1 * 9/2002 Paradowski ..... 62/613
6,640,586 B1 * 11/2003 Baudat et al. ..... 62/612
2003/0177785 A1 9/2003 Kimble et al.
2004/0129020 A1 * 7/2004 Jones et al. ..... 62/612
2004/0134196 A1 * 7/2004 Jones et al. ..... 60/772
2005/0279132 A1 12/2005 Eaton et al.

FOREIGN PATENT DOCUMENTS

WO WO 97/13109 4/1997

* cited by examiner

*Primary Examiner*—William C Doerrler

(57) ABSTRACT

A process and apparatus for the liquefaction of natural gas including at least one liquid expander for providing expansion of a high-pressure stream and powering a generator capable of producing electricity to be used to drive a compressor located elsewhere in the liquefaction apparatus. Particularly, a liquid expander is used to expand a high-pressure refrigerant stream and to power an electrical generator. The electricity provided by the generator can be used to power a compressor located in the same or a different refrigeration cycle as the liquid expander.

19 Claims, 3 Drawing Sheets

OPTIMIZED LNG SYSTEM WITH LIQUID EXPANDER

BACKGROUND OF THE INVENTION

1. Field of the Invention

Figure 1:
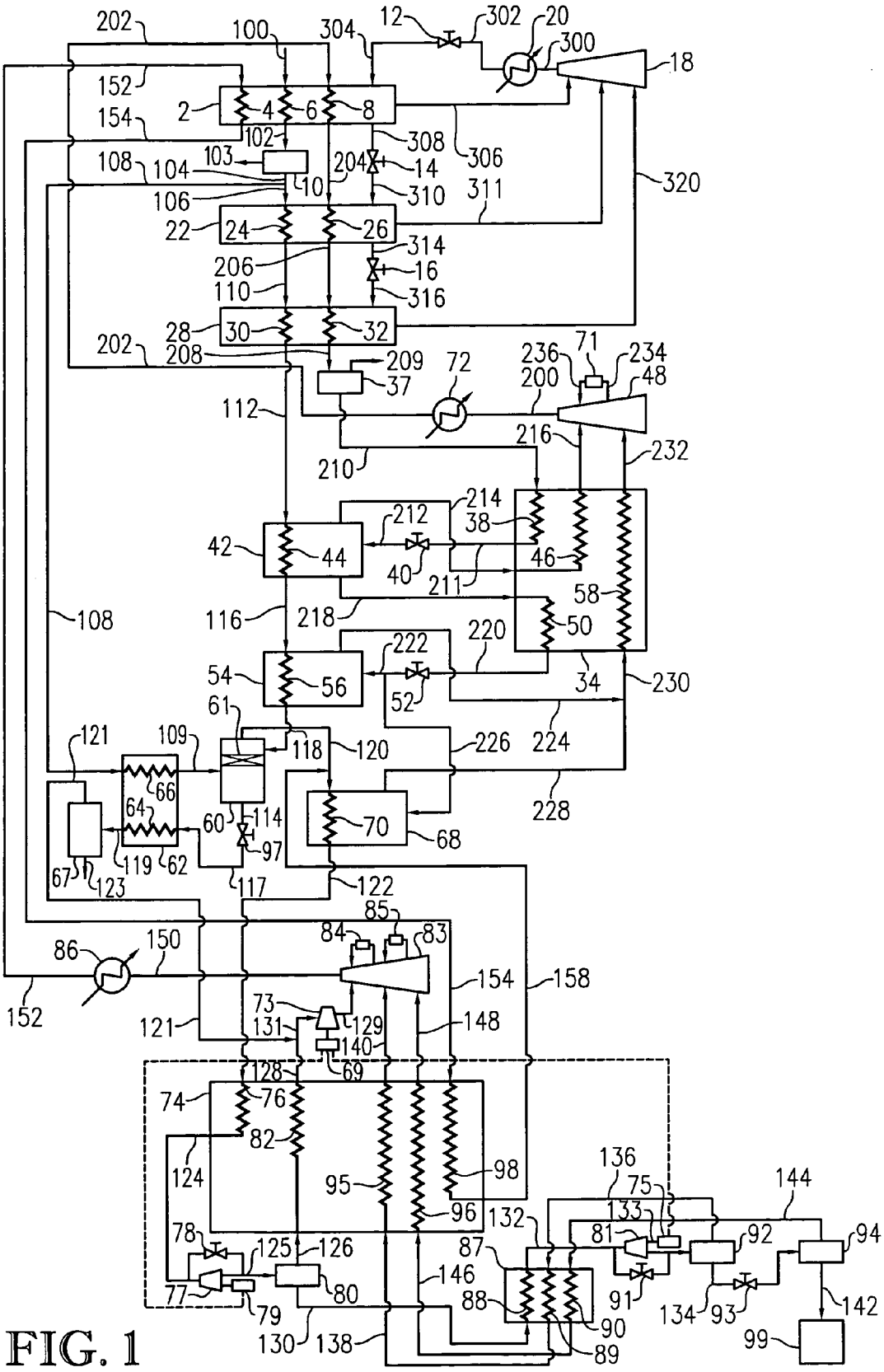

This invention relates to a method and apparatus for liquefying natural gas. In another aspect, the invention concerns an improved liquified natural gas (LNG) facility employing one or more liquid expanders for reducing the pressure of a process stream and generating electricity that is used to at least partially power a compressor located elsewhere in the facility. In still another aspect, the invention relates to a method and apparatus for reducing the pressure of a refrigerant stream in one of the closed or open refrigeration cycles in the LNG facility using a liquid expander, and generating electricity through this expansion to at least partially power a compressor situated in a location within the LNG facility that is remote from the liquid expander.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

As is typical with numerous processes of this type, the cooling of high-pressure streams can be achieved through the flashing or rapid expansion of the stream. This expansion is commonly affected through the use of joule-Thompson (J-T) expansion valves. The use of J-T valves results in the adiabatic expansion of the stream. Other types of equipment, such as liquid expanders, can be used to perform this expansion. Liquid expanders generally result in tropic expansion and have the benefit of producing work as the stream passes therethrough. This work can be harnessed via a shaft connected to another piece of equipment such as a compressor. The main disadvantage with this type of direct mechanical coupling of an expander and a compressor is that both pieces of equipment must be located in very close proximity to one another. Therefore, such optimizations must be considered when originally designing the LNG facility in order to most efficiently situate the equipment and conduit lines. It is difficult to retrofit an existing facility with this type of direct mechanically coupled expander/compressor arrangement due to the fact that the high-pressure stream may not be located near the stream needing to be compressed. Therefore, a real need exists for a method and apparatus for enabling the extraction of energy from high-pressure streams in an LNG facility and using that energy elsewhere in the facility without necessitating major reconfigurations of the plant design so that the expander and compressor can be positioned in close proximity to each other.

OBJECTS AND SUMMARY OF THE INVENTION

It is, therefore, an object of the present invention to provide a method and apparatus for reducing the pressure of a processed stream in an improved liquified natural gas facility using a liquid expander and meanwhile generating electricity that is used to at least partially power a compressor located in a remote section of the facility.

A further object of the invention is to provide a method and apparatus for reducing the pressure of a refrigerant stream in one of the closed or open refrigeration cycles of a cascaded LNG facility using a liquid expander and generating electricity used to at least partially power a compressor located in the same or different refrigeration cycle as the expander.

It should be understood that the above objects are exemplary and need not all be accomplished by the invention claimed herein. Other objects and advantages of the invention will be apparent from the written description and drawings.

Accordingly, one aspect of the present invention concerns a method of extracting energy from a plurality of pressurized streams in a natural gas liquefaction process, the method comprising the steps of: (a) passing a first pressurized stream through a first liquid expander to generate work; (b) passing a second pressurized stream through a second liquid expander to generate work; (c) converting at least a portion of the work generated by the first and second liquid expanders into electricity; and (d) using the electricity to power a first compressor.

Another aspect of the present invention concerns a method of extracting energy from a pressurized refrigerant stream in a closed refrigeration cycle of a natural gas liquefaction process, the method comprising the steps of: (a) passing the pressurized refrigerant stream of the closed refrigeration cycle through a liquid expander to generate work; (b) converting at least a portion of the work generated by the liquid expander into electricity; and (c) using the electricity to power a first compressor used in the closed refrigeration cycle.

A further aspect of the present invention concerns a method of extracting energy from a pressurized stream in a natural gas liquefaction process employing a plurality of refrigeration cycles, the method comprising the steps of: (a) passing a pressurized stream of a first refrigeration cycle through a liquid expander to generate work; (b) converting at least a portion of the work generated by the liquid expander into electricity; and (c) using the electricity to power a first compressor used in a second refrigeration cycle.

Still another aspect of the present invention concerns an apparatus for extracting energy from pressurized streams in a natural gas liquefaction process, the apparatus comprising: (a) a first liquid expander mechanically coupled with a first generator; (b) a second liquid expander mechanically coupled with a second generator; and (c) a compressor mechanically coupled with a motor powered with electricity supplied by the first and second generators.

Yet another aspect of the present invention concerns an apparatus for extracting energy from a pressurized refrigerant stream in a first closed refrigeration cycle of a natural gas liquefaction process, the apparatus comprising: (a) a liquid expander mechanically coupled with a generator and located in the first closed refrigeration cycle; (b) a main refrigerant compressor; and (c) a booster compressor located upstream from the main refrigerant compressor and mechanically coupled with a motor powered by electricity supplied by said generator.

BRIEF DESCRIPTION OF THE DRAWING FIGURES

Figure 2:
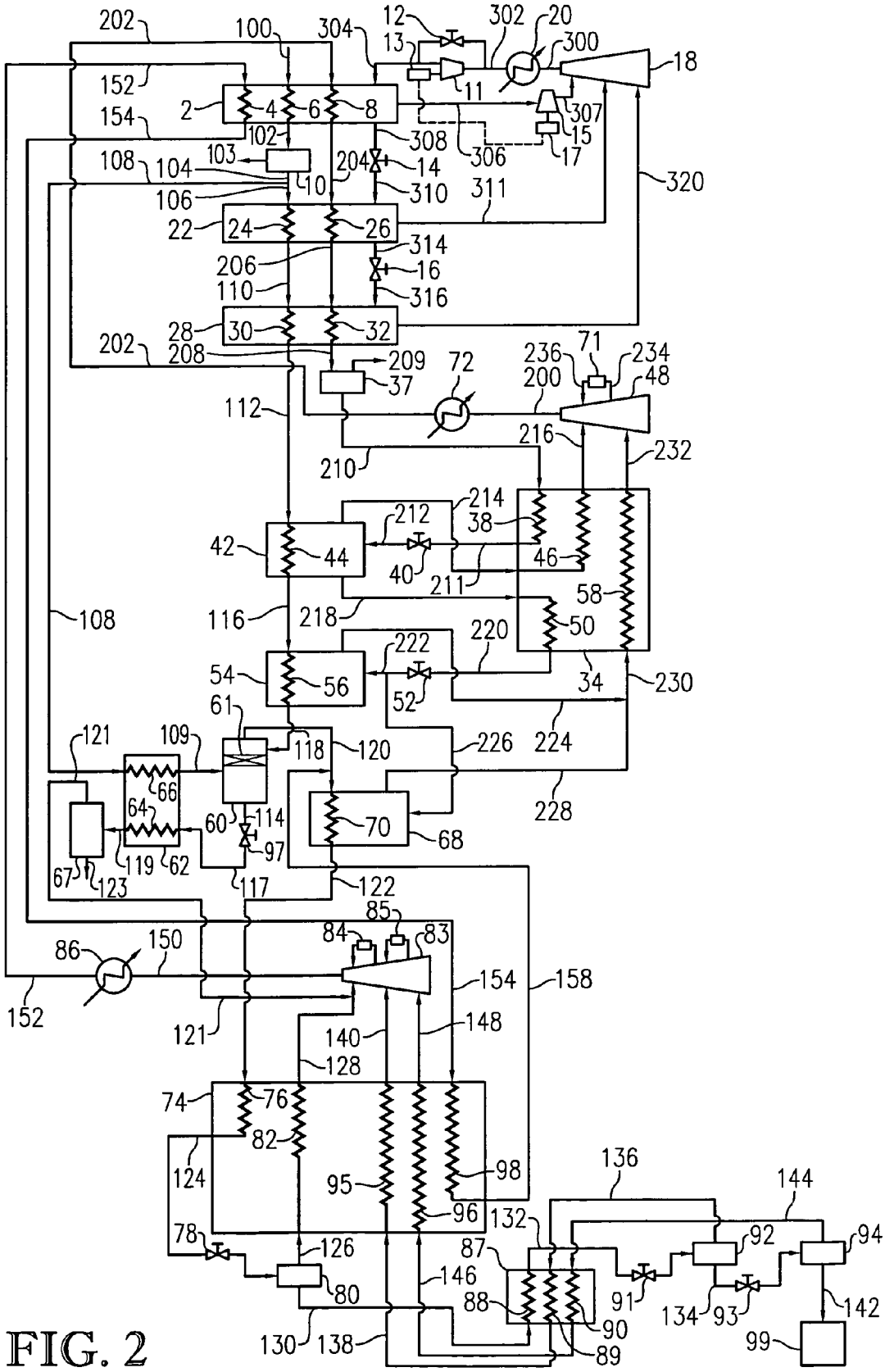
Figure 3:
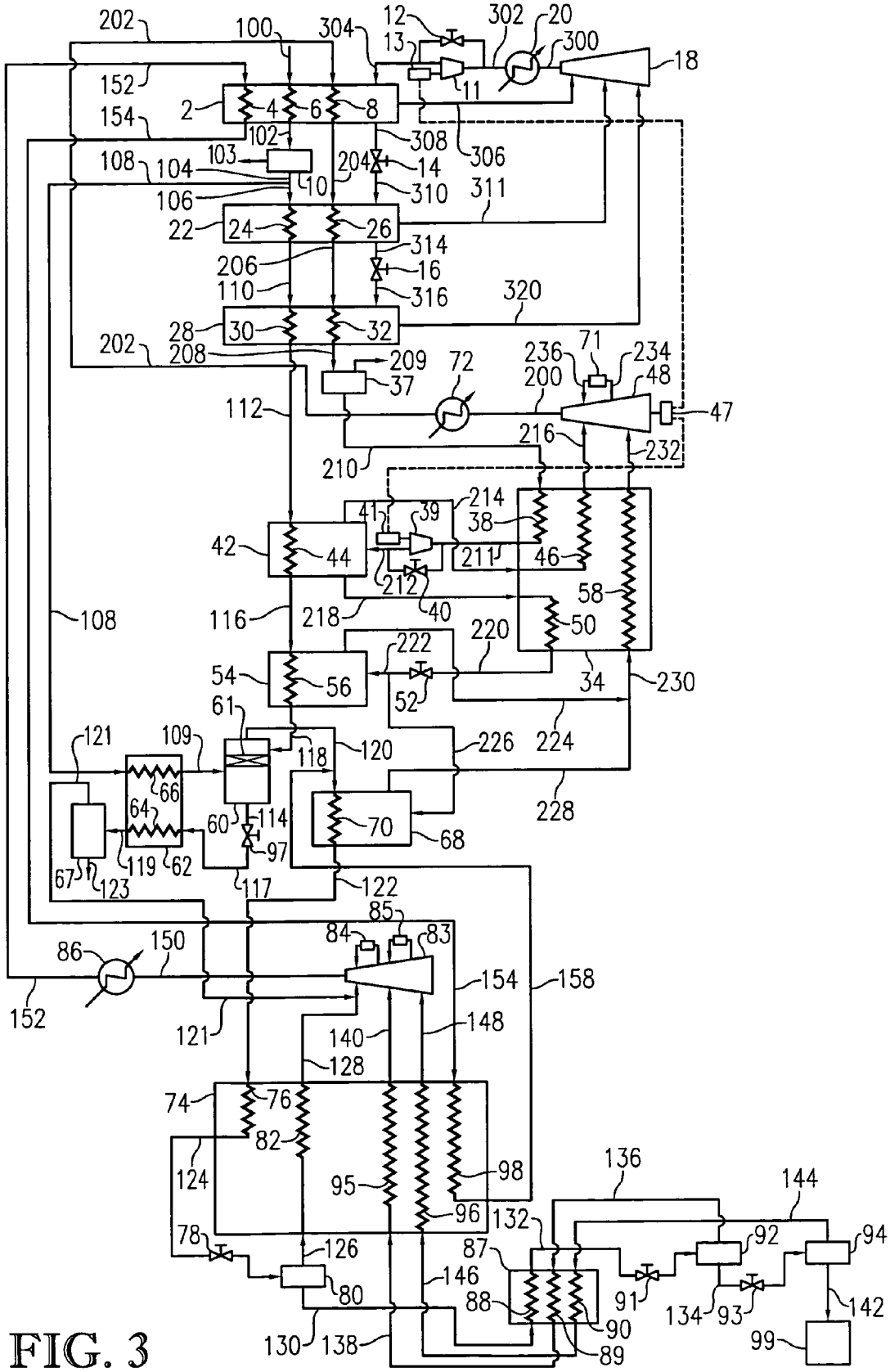

A preferred embodiment of the present invention is described in detail below with reference to the attached drawing figures, wherein:

FIG. 1 is a simplified flow diagram of a cascaded refrigeration process for LNG production employing a pair of liquid expanders located in the methane refrigeration cycle that power a booster compressor located in the same cycle;

FIG. 2 is a simplified flow diagram of a cascaded refrigeration process for LNG production employing a liquid expander located in the propane refrigerant cycle that powers a booster compressor located in the same refrigerant cycle; and FIG. 3 is a simplified flow diagram of a cascaded refrigeration process for LNG production employing one liquid expander located in the methane refrigeration cycle and one liquid expander located in the ethylene refrigeration cycle, each of which supply power to a main compressor located in the ethylene refrigeration cycle.

DETAILED DESCRIPTION OF THE PREFERRED EMBODIMENT

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term "open-cycle cascaded refrigeration process" refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominantly methane stream is employed as the refrigerant/cooling agent in the open cycle. This predominantly methane stream originates from the processed natural gas feed stream and can include the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, "refrigerant chiller" refers to a device that cools a feed stream via indirect heat exchange with a refrigerant. "Propane refrigerant chiller" refers to a refrigerant chiller that employs a predominantly propane refrigerant or a refrigerant having a boiling point within 20° C. of propane. "Ethylene refrigerant chiller" refers to a refrigerant chiller that employs a predominantly ethylene refrigerant or a refrigerant having a boiling point within 20° C. of ethylene.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing certain undesirable components, such as acid gases, mercaptan, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$, and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via sequential expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thompson expansion valve. In another embodiment, the expansion means is either a hydraulic or gas expander. Because expanders recover work energy from the expansion process, lower process stream temperatures are possible upon expansion.

The flow schematic and apparatus set forth in FIGS. 1-3 represent preferred embodiments of the inventive LNG facility employing liquid expanders to facilitate pressure reduction and/or cooling of certain streams and to at least partially power compressors located throughout the facility. Those skilled in the art will recognized that FIGS. 1-3 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1-3, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams.

Referring to FIG. 1, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204. The gas in conduit 154 is fed to a main methane economizer 74 which will be discussed in greater detail in a subsequent section and wherein the stream is cooled via indirect heat exchange means 98. The resulting cooled compressed methane recycle stream produced via conduit 158 is then combined in conduit 120 with the heavies depleted (i.e., light-hydrocarbon rich) vapor stream from a heavies removal column 60 and fed to an ethylene chiller 68.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310, thereby providing a coolant for chiller 22. The cooled feed gas stream from chiller 2 flows via conduit 102 to separation equipment 10 wherein gas and liquid phases are separated. The liquid phase, which can be rich in $C_3$+ components, is removed via conduit 103. The gaseous phase is removed via conduit 104 and then split into two separate streams which are conveyed via conduits 106 and 108. The stream in conduit 106 is fed to propane chiller 22. The stream in conduit 108 becomes the feed to heat exchanger 62 and ultimately becomes the stripping gas to heavies removal column 60, discussed in more detail below. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller 28 via conduit 110. In chiller 28, the stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant is totally condensed or condensed in nearly its entirety via indirect heat exchange means 32. The vaporized propane is removed from low-stage propane chiller 28 and returned to the low-stage inlet of compressor 18 via conduit 320.

The methane-rich stream exiting low-stage propane chiller 28 is introduced to high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and fed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 44, the methane-rich stream is removed from high-stage ethylene chiller 42 via conduit 116. This stream is then condensed in part via cooling provided by indirect heat exchange means 56 in low-stage ethylene chiller 54, thereby producing a two-phase stream which flows via conduit 118 to heavies removal column 60. As previously noted, the methane-rich stream in line 104 was split so as to flow via conduits 106 and 108. The contents of conduit 108, which is referred to herein as the stripping gas, is first fed to heat exchanger 62 wherein this stream is cooled via indirect heat exchange means 66 thereby becoming a cooled stripping gas stream which then flows via conduit 109 to heavies removal column 60. The stripping gas preferably enters heavies removal column at a location below the column's internal packing 61. A heavies-rich liquid stream containing a significant concentration of $C_4$+ hydrocarbons, such as benzene, cyclohexane, other aromatics, and/or heavier hydrocarbon components, is removed from heavies removal column 60 via conduit 114, preferably flashed via a flow control means 97, preferably a control valve which can also function as a pressure reduction, and transported to heat exchanger 62 via conduit 117. Preferably, the stream flashed via flow control means 97 is flashed to a pressure about or greater than the pressure at the high stage inlet port to methane compressor 83. Flashing also imparts greater cooling capacity to the stream. In heat exchanger 62, the stream delivered by conduit 117 provides cooling capabilities via indirect heat exchange means 64 and exits heat exchanger 62 via conduit 119. In heavies removal column 60, the two-phase stream introduced via conduit 118 is contacted with the cooled stripping gas stream introduced via conduit 109 in a countercurrent manner thereby producing a heavies-depleted vapor stream via conduit 120 and a heavies-rich liquid stream via conduit 114.

The heavies-rich stream in conduit 119 is subsequently separated into liquid and vapor portions or preferably is flashed or fractionated in vessel 67. In either case, a heavies-rich liquid stream is produced via conduit 123 and a second methane-rich vapor stream is produced via conduit 121. As explained in greater detail below, the stream in conduit 121 is subsequently combined with a second stream delivered via conduit 128, and the combined stream fed to a booster compressor 73 located upstream of the high-stage inlet port of the methane compressor 83.

As previously noted, the gas in conduit 154 is fed to main methane economizer 74 wherein the stream is cooled via indirect heat exchange means 98. The resulting cooled compressed methane recycle or refrigerant stream in conduit 158 is combined in the preferred embodiment with the heavies-depleted vapor stream from heavies removal column 60, delivered via conduit 120, and fed to a low-stage ethylene chiller 68. In low-stage ethylene chiller 68, this stream is cooled and condensed via indirect heat exchange means 70 with the liquid effluent from valve 222 which is routed to low-stage ethylene chiller 68 via conduit 226. The condensed methane-rich product from low-stage condenser 68 is produced via conduit 122. The vapor from low-stage ethylene chiller 54, withdrawn via conduit 224, and low-stage ethylene chiller 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As noted in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is preferably at a temperature in the range of from about −200 to about −50° F., more preferably in the range of from about −175 to about −100° F., most preferably in the range of from −150 to −125° F. The pressure of the stream in conduit 122 is preferably in the range of from about 500 to about 700 psia, most preferably in the range of from 550 to 725 psia.

The stream in conduit 122 is directed to a main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. It is preferred for the temperature of the stream in conduit 124 to be at least about 10° F. less than the temperature of the stream in conduit 122, more preferably at least about 25° F. less than the temperature of the stream in conduit 122. Most preferably, the temperature of the stream in conduit 124 is in the range of from about −200 to about −160° F.

The stream in conduit 124 is passed through liquid expander 77 in order to primarily reduce the pressure and effect a cooling thereof. Passage of the stream through expander 77 produces a two-phase stream that is then delivered to high-stage methane flash drum 80 through conduit 125. Liquid expander 77 is operably coupled through a shaft with an electric generator 79 which produces and electric current in response to passage of the stream from conduit 124 through expander 77. A by-pass valve 78 is selectively opened or closed to control the volume of fluid flowing through expander 77. Valve 78 is generally located in parallel to expander 77 and can be a Joule-Thompson valve so as to carry out the necessary pressure reduction of the stream in conduit 124 should expander 77 be down for any reason. In flash drum 80, the two-phase stream is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant in heat exchanger pass 82 and aids in the cooling of the stream in heat exchanger pass 76. Thus, the predominantly methane stream in heat exchanger pass 82 is warmed, at least in part, by indirect heat exchange with the predominantly methane stream in heat exchanger pass 76. The warmed stream exits heat exchanger pass 82 and methane economizer 74 via conduit 128. It is preferred for the temperature of the warmed predominantly methane stream exiting heat exchanger pass 82 via conduit 128 to be at least about 10° F. greater than the temperature of the stream in conduit 124, more preferably at least about 25° F. greater than the temperature of the stream in conduit 124. The temperature of the stream exiting heat exchanger pass 82 via conduit 128 is preferably warmer than, about −50° F., more preferably warmer than about 0° F., still more preferably warmer than about 25° F., and most preferably in the range of from 40 to 100° F.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is directed to liquid expander 81 for pressure reduction and cooling. Passage of the stream through expander 81 produces a two-phase stream that is passed to an intermediate-stage methane flash drum 92 via conduit 133. Liquid expander 81 is operably coupled through a shaft with an electric generator 75 which produces an electric current in response to passage of the stream from conduit 132 through expander 81. A by-pass valve 91 is used to control the volume of fluid flowing through expander 81. Valve 91 is generally located parallel to expander 81 and can be a Joule-Thompson valve so as to carry out the necessary pressure reduction of the stream in conduit 132 should expander 81 be down for any reason. In flash drum 92, the two-phase stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140, is combined with the first nitrogen-reduced stream in conduit 406, and the combined stream is conducted to the intermediate-stage inlet of methane compressor 83.

The liquid phase exiting intermediate-stage flash drum 92 via conduit 134 is further reduced in pressure by passage through a pressure reduction means, illustrated as a expansion valve 93. Again, a third portion of the liquefied gas is evaporated or flashed. The two-phase stream from expansion valve 93 are passed to a final or low-stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148, is combined with the second nitrogen-reduced stream in conduit 408, and the combined stream is conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

The stream exiting exchanger pass 82 via conduit 128 is combined with the methane-rich vapor stream carried by conduit 121 and the combined stream is directed through conduit 131 to a booster compressor 73 located upstream of the high-stage inlet to compressor 83. Booster compressor 73 is operably coupled with a motor 69 through a shaft. Motor 69 is powered, at least in part, and preferably completely, by electricity supplied by generators 75, 79. A pair of dashed lines in FIG. 1 extending from generators 75, 79 to motor 69 schematically illustrate the electrical connection therebetween. A pre-compressed stream exits booster compressor 73 via conduit 129 which is then combined with the stream in conduit 154 and delivered to the high-stage inlet of compressor 83. The embodiment of the present invention illustrated in FIG. 1 depicts a plurality of liquid expanders located in the same refrigeration cycle (particularly an open refrigeration cycle) which are employed to produce electricity to power a compressor also located within that same refrigeration cycle. In so doing, excess pressure contained within several streams of this cycle is harnessed to perform work in other areas of the process. Additionally, the use of liquid expanders to generate electricity enables the compressor powered thereby to be physically situated in the plant in its most desirable location as opposed to its location being dictated by the need for mechanical coupling with the liquid expander.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage of ethylene cooling.

In the embodiment of the present invention illustrated in FIG. 2, a liquid expander 11 performs the expansion generally provided in FIG. 1 by expansion valve 12. The stream exiting cooler 20 via conduit 302 is fed through expander 11 wherein the pressure of the stream is reduced and the stream is cooled. This expanded stream is then transported to high-stage propane chiller 2 via conduit 304. Generator 13 is operably coupled with expander 11 via a shaft and generates electricity as the stream passes through expander 11. In order to control the volume of fluid flowing through expander 11, valve 12 becomes a by-pass valve. Valve 12 can still be an expansion-type valve so as to carry out the necessary pressure reduction of the stream in conduit 302 should expander 11 be down for any reason.

As shown in FIG. 2, the electricity generated by generator 13 is used to power a booster compressor 15 located upstream of the high-stage inlet to propane refrigerant compressor 18. Gaseous propane refrigerant exiting chiller 2 via conduit 306 is directed toward booster compressor 15 which is powered by motor 17. Motor 17 is operably coupled with booster compressor 15 through a shaft, and is powered at least in part by, and preferably entirely by, electricity generated from generator 13. This electrical connection is shown as a dashed line extending between generator 13 and motor 17. The propane refrigerant stream exits booster compressor 15 and is delivered to the high-stage inlet of compressor 18 via conduit 307. Thus, this embodiment reflects an optimization of a closed refrigeration cycle whereby excess pressure in the refrigerant stream is utilized to generate energy for use elsewhere in the same refrigeration cycle.

The embodiment of the present invention depicted in FIG. 3 represents a hybrid of the embodiments shown in FIGS. 1 and 2. As in FIG. 2, a liquid expander 11 is located downstream from cooler 20 and is operably coupled with a generator 13 for generation of electricity as propane refrigerant passes therethrough. In a similar fashion, expansion valve 40 as shown in FIG. 1 has been replaced with yet another liquid expander 39. Expander 39 is operably coupled with a generator 41 which generated electricity as the ethylene refrigerant stream in conduit 211 passes through expander 39. The reduced-pressure stream exiting expander 39 is transported to high-stage ethylene chiller 42 via conduit 212. A by-pass valve 4 is used to control the volume of fluid passing through expander 39. Valve 40 can be an expansion-type valve to effect the required pressure reduction of the refrigerant stream transported by conduit 211 should expander 39 be down for any reason.

The electricity generated by generators 13, 41 is used to at least partially power a motor 47 that is operably coupled with compressor 48 via a shaft. This electrical connection is depicted as a pair of dashed lines extending from generators 13, 41 to motor 47. This arrangement depicts the harnessing of energy from two different refrigeration cycles that is used to perform work in another location of the LNG plant. The present optimization shown in FIG. 3 would present a substantial engineering challenge if the expanders were required to be mechanically coupled with the compressor. Instead, the individual pieces of equipment can be situated at any convenient location within the plant.

It is apparent that it is within the scope of the present invention to employ one or more liquid expanders in the LNG liquefaction process disclosed above at any location in which it is desirable to perform an expansion of a stream. For example, the liquid expanders may be located in any stream where pressure reduction and cooling is desired. Liquid expanders may be situated in the same or different refrigeration cycles. The electricity generated by the generators coupled with the expanders can be routed to any location within the LNG facility. Particularly, it is preferable to use the electricity to power a booster compressor or main compressor located in one of the refrigeration cycles. The compressor may be situated in the same refrigeration cycle as at least one of the expanders, or in a refrigeration cycle that is completely different than the cycles in which the expanders are located.

In one embodiment of the present invention, the LNG production systems illustrated in FIGS. 1-3 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of liquefying a natural gas stream in an LNG facility, said method comprising:

(a) cooling at least a portion of said natural gas stream in an upstream refrigeration cycle via indirect heat exchange with an upstream refrigerant to thereby provide a cooled natural gas stream;

(b) separating at least a portion of said cooled natural gas stream into a predominantly methane vapor overhead fraction and a predominantly liquid bottoms fraction in a first distillation column;

(c) cooling at least a portion of said predominantly methane vapor overhead fraction in a second refrigeration cycle via indirect heat exchange with a second refrigerant to thereby provide a cooled predominantly methane stream;

(d) passing at least a portion of said cooled predominantly methane stream through a first expander to generate work and to thereby provide a first expanded predominantly methane stream;

(e) separating at least a portion of said first expanded predominantly methane stream in a first separation vessel to thereby provide a first vapor stream and a first liquid stream;

(f)

(g) converting at least a portion of the work generated by said first expander into electricity; and (h) using the electricity generated in step (g) to power a first compressor, wherein said first compressor is used to compress at least a portion of said first vapor stream.

2. The method according to claim 1, said LNG facility comprising a plurality of cascaded refrigeration cycles.

3. The method according to claim 2, said first compressor being located in the same refrigeration cycle as the first.

4. The method according to claim 2, said first refrigerant comprising a pure component refrigerant, said pure component refrigerant comprising predominantly propane, predominantly ethylene, predominantly ethane, or propylene.

5. The method according to claim 1; and (i) further compressing said at least a portion of said first vapor stream compressed by said first compressor with a second compressor downstream of the first compressor.

6. A method of liquefying a natural gas stream in a liquefied natural gas (LNG) facility, said method comprising:

(a) discharging a first compressed refrigerant stream from a first refrigerant compressor in a first upstream refrigeration cycle;

(b) using at Least a portion of said first compressed refrigerant stream to cool at least a portion of a predominantly methane stream to thereby provide a cooled predominantly methane stream and a first warmed refrigerant stream;

(c) discharging a second compressed refrigerant stream from a second refrigerant compressor in a second refrigeration cycle;

(d) using at least a portion of said second compressed refrigerant stream to cool at least a portion of said cooled predominantly methane stream to thereby provide a further cooled predominantly methane stream and a second warmed refrigerant stream;

(e) expanding at least a portion of said further cooled predominantly methane stream in a first expander to thereby provide an expanded predominantly methane stream;

(f) separating said expanded predominantly methane stream into a predominantly vapor fraction and a predominantly liquid fraction in a first separation vessel, wherein said second compressed refrigerant stream comprises said predominantly vapor fraction;

(g) passing at least a portion of said first compressed refrigerant stream and/or said second compressed refrigerant stream through a second and/or third expander prior to said cooling of steps (b) and/or (d) to generate work;

(h) converting at least a portion of the work generated by said second and/or third expander into electricity; and (i) using the electricity generated in step (h) to power said first and/or said second refrigerant compressor and/or a booster compressor used to compress said first and/or said second warmed refrigerant streams before said first and/or second refrigerant streams are introduced into said first and/or said second refrigerant compressors.

7. The method according to claim 6, said LNG facility comprising a plurality of cascaded refrigeration cycles.

8. The method according to claim 6, said first refrigerant comprising a pure component refrigerant, wherein said pure component refrigerant comprises predominantly propane, predominantly ethylene, predominantly ethane, or predominantly propylene.

9. The method according to claim 6; and (j) controlling the flow of said first and/or said second compressed refrigerant stream through said second and/or said third expander by selectively opening or closing a by-pass valve.

10. The method according to claim 9, said by-pass valve comprising an expansion valve.

11. An apparatus for liquefying a natural gas stream, said apparatus comprising:

(a) a first refrigeration cycle comprising a first heat exchanger, said first heat exchanger comprising a first warm natural gas inlet, a first cool natural gas outlet, a first cool refrigerant inlet, and a first warm refrigerant outlet;

(b) a first distillation column located downstream of said first refrigeration cycle, said first distillation column comprising a first fluid inlet, a first vapor outlet, and a first liquid outlet, said first fluid inlet in fluid flow communication with said first cool natural gas outlet of said first refrigeration cycle;

(c) a second refrigeration cycle comprising a second heat exchanger, a third heat exchanger, a first expander mechanically coupled with a first generator, and a second expander mechanically coupled with a second generator; and (d) a compressor mechanically coupled with a motor powered with electricity supplied by said first and second generators, wherein said second and third heat exchangers respectively comprise second and third warm natural gas inlets and second and third cool natural gas outlets, wherein said second warm natural gas inlet of said second heat exchanger is in fluid flow communication with said first vapor outlet of said first distillation column;

wherein said first expander is fluidly disposed upstream of said second heat exchanger generally between said first vapor outlet of said first distillation column and said second warm natural gas inlet of said second heat exchanger, wherein said second expander is fluidly disposed between said cool natural gas outlet of said second heat exchanger and said third warm natural gas inlet of said third heat exchanger.

12. The apparatus according to claim 11, said compressor located in the first refrigeration cycle.

13. The apparatus according to claim 11, said compressor located in said second refrigeration cycle.

14. The apparatus according to claim 11; and a first by-pass valve positioned in parallel with the first expander; and a second by-pass valve positioned in parallel with the second expander.

15. The apparatus according to claim 14, said first and second by-pass valves operable to control the flow of the pressurized streams through the first and second liquid expanders.

16. The apparatus according to claim 14, said first and second by-pass valves being expansion valves.

17. The method according to claim 1, further comprising, subsequent to step (e), cooling at least a portion of said first liquid stream to thereby provide a cooled liquid stream and, thereafter, passing at least a portion of said cooled liquid stream through a second expander to generate work, wherein at least a portion of the work generated from the second expander is converted to electricity and used to power said first compressor.

18. The method according to claim 1, wherein said second refrigerant comprises at least a portion of said first vapor stream.

19. The method of according to claim 1, wherein said second refrigerant comprises a pure component ethane refrigerant, a pure component ethylene refrigerant, or a predominantly methane refrigerant.

* * * * *